United States Patent [19]

Ikehata et al.

[11] 4,044,543

[45] Aug. 30, 1977

[54] SWITCHING MECHANISM OF AN ELECTRONIC WRIST WATCH

[75] Inventors: Yukio Ikehata; Nobuo Ohara; Yasuhiro Kawanishi; Shigeyuki Masuda; Isamu Nishida; Hideyuki Nakao, all of Tokyo, Japan

[73] Assignee: Kabushiki Kaisha Daini Seikosha, Japan

[21] Appl. No.: 755,071

[22] Filed: Dec. 28, 1976

[51] Int. Cl.[2] ..... G04C 3/00

[52] U.S. Cl. ..... 58/23 R; 58/85.5; 58/63; 200/52 R; 200/153 P; 200/153 V

[58] Field of Search ..... 58/23 R, 50 R, 85.5, 58/63, 67, 68; 200/52 R, 153 P, 153 V

[56] References Cited

U.S. PATENT DOCUMENTS

| | | | |
|---|---|---|---|
| 3,762,153 | 10/1973 | Komiyama et al. | 58/85.5 X |
| 3,796,038 | 3/1974 | Ushiyama | 58/85.5 X |
| 3,841,081 | 10/1974 | Komaki | 58/85.5 X |
| 3,945,190 | 3/1976 | Kimura et al. | 58/85.5 X |

*Primary Examiner*—Ulysses Weldon

*Attorney, Agent, or Firm*—Robert E. Burns; Emmanuel J. Lobato; Bruce L. Adams

[57] ABSTRACT

The switching mechanism for setting the time in an electronic wrist watch comprises a switch blade actuated by a double-lobe cam which is connected by a lost-motion coupling with a coaxial transmission wheel having at its periphery gear teeth meshing with a winding pinion on a round part of the winding stem which is perpendicular to the axis of the transmission wheel and cam. The winding pinion and a clutch wheel which is rotatable with the winding stem have rectangular teeth which are engageable with each other to connect the winding pinion with the winding stem. A protuberance of a cam spring is engageable with one lobe of the cam to restrain rotation of the cam until the lost-motion coupling reaches the end of its travel. The construction permits its use in a thin watch.

3 Claims, 2 Drawing Figures

SWITCHING MECHANISM OF AN ELECTRONIC WRIST WATCH

FIELD OF THE INVENTION

The present invention relates to a switching mechanism of an electronic wristwatch for correcting the time-setting of the watch.

BACKGROUND OF THE INVENTION

In the conventional switching mechanism of an electronic wristwatch a protuberance of a spring biased cam is received in a notch portion of a winding stem. When the stem is turned the cam is rotated. With this construction the thickness of the watch is increased by the longitudinal length of the cam so that it is not possible to have a thin wristwatch.

SUMMARY OF THE INVENTION

It is an object of the present invention to eliminate the disadvantages of the conventional switching mechanism. In accordance with the invention a clutch wheel and a winding pinion coaxial with the winding stem both have rectangular teeth which intermesh to connect the winding pinion with the winding stem. The winding pinion meshes with the teeth of a transmission wheel which is rotatable about an axis perpendicular to the axis of the winding stem and is coupled by a lost-motion device with a springcontrolled cam for operating a spring switch blade. With this mechanism the diameter of the winding stem can be small and the thickness of the watch can be reduced.

BRIEF DESCRIPTION OF THE DRAWINGS

The nature, objects and advantages of the invention will be more fully understood from the following description of a preferred embodiment illustrated by way of example in the accompanying drawings in which.

DESCRIPTION OF PREFERRED EMBODIMENT

Figure 1:
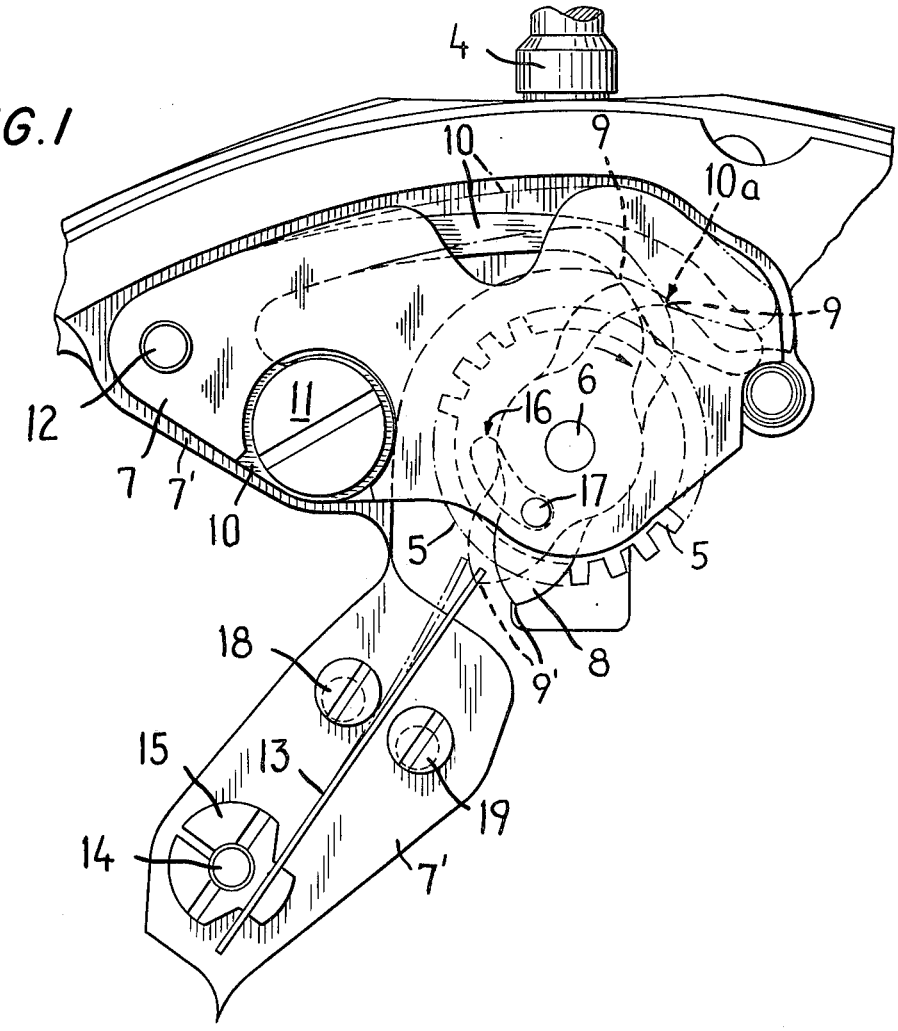
FIG. 1 is a fragmentary plan view of switching mechanism in accordance with the invention and FIG. 2 is a vertical longitudinal side view shown partially in sections.

In the embodiment of the invention shown by way of example in the drawings a clutch wheel 1 is axially slidable on a square portion 4*a* of a winding stem 4 so as to rotate with the winding stem. A winding pinion 2 which is rotatably supported on a round portion 4*b* of the winding stem 4 has on its inner end face rectangular teeth 3 which are engageable with like teeth on the adjacent end of the clutch wheel 1 so as to couple the winding pinion 2 with the clutch wheel 1 and hence with the winding stem 4 when the clutch wheel 1 is in the position shown in FIG. 2. The clutch wheel 1 is slidable in an axial direction on the square portion 4*a* of the winding stem 4 in order to engage or disengage the teeth 3 of the winding pinion 2 by the usual stem changing mechanism (not shown) comprising a setting lever 40 engaging in annular groove 1*a* in the clutch wheel 1 and operated by a setting lever. The winding pinion 2 meshes with a transmission gearwheel 5 which is rotatable on a pin 6 which is mounted on a plate 7 and is perpendicular to the axis of the winding stem 4. A double-lobe cam 8 also rotatable on the pin 6 is provided at opposite ends with concave portions 9 and 9'. A cam spring 10 which is mounted on a plate 7' by a screw 11 and pin 12 has at its free end portion a protuberance 10*a* which is located in the rotating locus of the concave portions 9, 9' of the cam 8. An electrically conductive switching spring 13 has one end portion which is fixed in a slot of a mounting member 15 which is rotatably and adjustably mounted on the plate 7' by a pin 14 so that the position of the switching spring 13 can be adjusted. The other end portion of the switching spring 13 is positioned in the rotating locus of the concave portion 9' of the cam 8 so as to be engageable by the cam. The cam 8 is coupled with the transmission gear wheel 5 by a lost-motion connection comprising a protuberance 17 on the cam which fits into an arcuate slot 16 in the transmission gear wheel, it being understood that conversely the protuberance could be on the transmission gear wheel and the arcuate slot could be in the cam 8.

Figure 2:
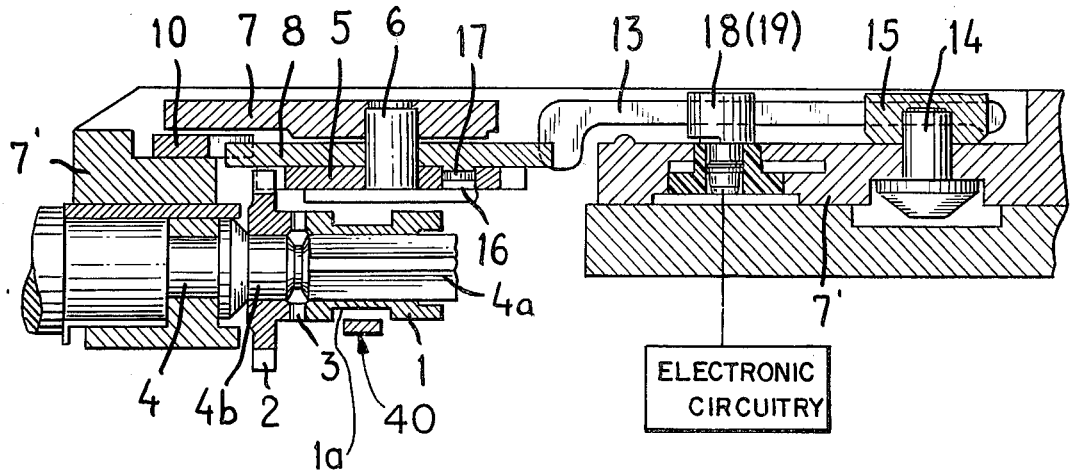

When the clutch wheel 1 is in the position shown in FIG. 2 rotation of the winding stem 4 rotates the winding pinion 2 and hence the transmission gear wheel 5. As the transmission gear wheel 5 is provided with the arcuate slot 16, the transmission gear wheel can rotate through a selected angle without rotating the cam 8 rotation of which is restrained by the protuberance 10*a* on the spring 10. When the protuberance 17 reaches the end of the arcuate slot 16, continued rotation of the transmission wheel 5 causes the cam 8 to rotate in a clockwise direction about the pin 6 and the concave portion 9 of the cam 8 pushes the free end portion of the cam spring 10 upwardly against the elasticity of the cam spring. When the concave portion 9 of the cam 8 passes the protruding portion 10*a* the cam spring 10 returns by its elasticity and the cam spring 10 rotates the cam 8 to the extent of the length of the arcuate slot 16. When the cam 8 rotates clockwise, the switching spring 13 is pushed to the left by the concave portion 9' and contacts with a terminal pin 18 and then the switching spring 13 parts from the terminal pin 18 and returns to its central position. On the other hand when the cam 8 rotates counterclockwise the switching spring 13 is pushed to the right by the concave portion 9' and contacts with a terminal pin 19 and then the switching part 13 parts from the terminal pin 19 and returns to the center. These terminal pins 18 and 19 are respectively connected to the electronic circuit (logic) so that at least two different actions such as time correction, reset or the like are actuated by the switching operation.

It will thus be seen that according to the present invention the clutch wheel and the winding pinion which are rotated by the winding stem both have rectangular teeth which intermesh to couple the winding pinion with the winding stem so that the winding stem diameter need not be large. Furthermore as the winding pinion and the transmission gear wheel are disposed at right angles to one another the transmission gear wheel, cam and cam spring are disposed in the plane of the watch so that the timepiece can be made quite thin.

As will be recognized by those skilled in the art modifications can be made and hence the invention is in no way limited to the preferred embodiment illustrated by way of example in the drawings and herein particularly described.

What we claim is:

1. A switching mechanism of an electronic wristwatch comprising a rotatable winding stem, a clutch wheel rotatable with but axially movable on said stem, a winding pinion rotatable on said stem adjacent said clutch wheel, said winding pinion and clutch wheel having on adjacent ends rectangular teeth engageable with one another to couple said winding pinion to said winding stem, a transmission gear wheel rotatable about an axis perpendicular to the axis of said winding stem and meshing with said winding pinion, a rotatable cam coaxial with and adjacent to said transmission gear wheel, lost-motion connecting means coupling said cam with said transmission gear wheel, spring means cooperating with said cam means to restrain rotation of said cam by rotation of said transmission gear wheel until one end of travel of said lost-motion connecting means is reached and then advancing said cam until the other end of said lost-motion connection is reached, and a switching spring engageable by said cam for flexing said switching spring into engagement with a contact connected with watch circuitry to perform a switching function.

2. A switching mechanism according to claim 1, in which said lost-motion connection between said transmission gear wheel and said cam comprises a protuberance on said cam received in an arcuate slot in said transmission gear wheel.

3. A switching mechanism according to claim 1 in which said cam has two opposite lobes and said spring means comprises a leaf spring having a protuberance engageable with one lobe of the cam while the other lobe is engageable with said switching spring.

* * * * *